United States Patent [19]

Shibuya et al.

[11] 4,086,040

[45] Apr. 25, 1978

[54] ROTARY COMPRESSOR COMPRISING IMPROVED ROTOR LUBRICATION SYSTEM

[75] Inventors: Tsunenori Shibuya; Hiroshi Kondo, both of Konan, Japan

[73] Assignee: Diesel Kiki Co., Ltd., Tokyo, Japan

[21] Appl. No.: 716,621

[22] Filed: Aug. 23, 1976

[30] Foreign Application Priority Data

Aug. 26, 1975 Japan ..... 50-118077[U]

[51] Int. Cl.[2] ..... F01C 21/04; F04C 29/02

[52] U.S. Cl. ..... 418/76; 418/81; 418/82; 418/93; 418/98; 418/100

[58] Field of Search ..... 418/91-94, 418/97-100, 76, 81, 82

[56] References Cited

U.S. PATENT DOCUMENTS

| | | | |
|---|---|---|---|
| 2,856,119 | 10/1958 | Smith | 418/98 |
| 3,385,514 | 5/1968 | Kilgore et al. | 418/98 |

FOREIGN PATENT DOCUMENTS

| | | | |
|---|---|---|---|
| 459,056 | 4/1928 | Germany | 418/93 |
| 619,921 | 10/1935 | Germany | 418/94 |
| 1,503,656 | 11/1969 | Germany | 418/97 |

*Primary Examiner*—John J. Vrablik
*Attorney, Agent, or Firm*—Frank J. Jordan

[57] ABSTRACT

A rotor is eccentrically mounted in a bore of a housing and formed with radial slots in which vanes are slidably retained. An oil passageway leads from an oil sump through the radially inner portions of the slots to a fluid inlet passageway, the oil sump communicating with an oil separation chamber which constitutes part of a fluid outlet passageway. The high pressure in the oil separation chamber forces oil through the oil passageway to lubricate the vanes and urge the vanes into sealing engagement with the inner wall of the bore. Oil sucked from the inlet passageway into the bore and entrained in the working fluid lubricates the outer ends of the vanes and flows into the oil separation chamber. The fluid outlet passageway is formed so that the fluid flow path reverses direction in the oil separation chamber. The oil entrained in the fluid is unable, due to its higher density and inertial force, to negotiate the reversal of direction, is thereby separated from the fluid and returned to the oil sump.

6 Claims, 3 Drawing Figures

Fig. 1
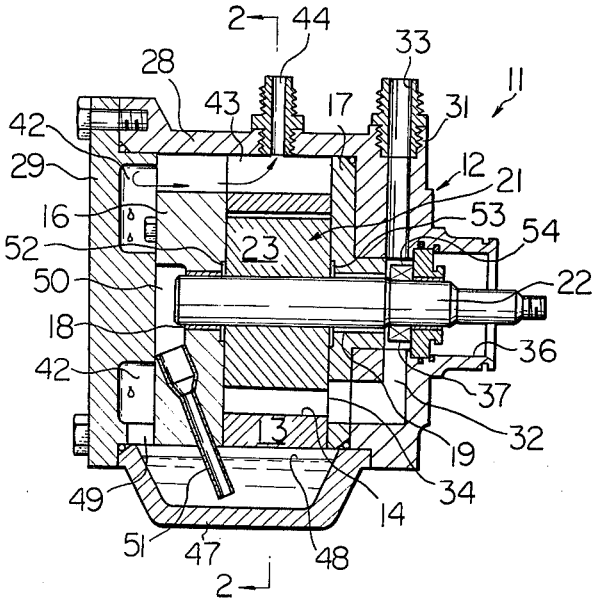
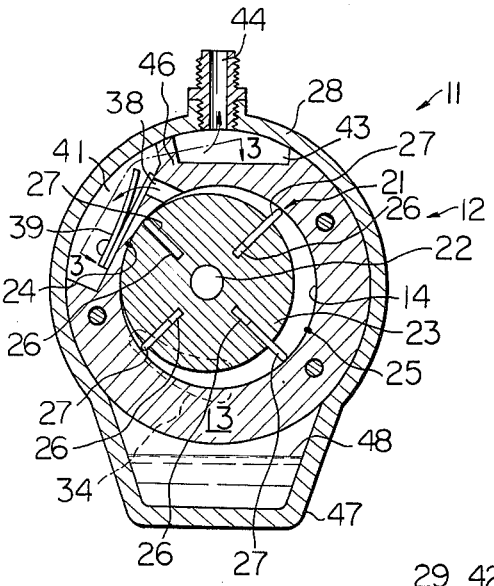
Fig. 2
Fig. 3
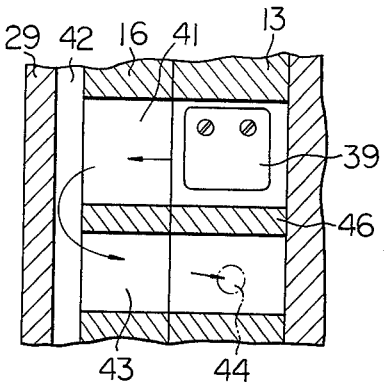

ROTARY COMPRESSOR COMPRISING IMPROVED ROTOR LUBRICATION SYSTEM

BACKGROUND OF THE INVENTION

The present invention relates to a rotary compressor comprising an improved rotor lubrication system, and more particularly to a rotary compressor in which an oil separation function, provided in prior compressors by an oil separator component, is provided by a unique configuration of an outlet passageway.

A rotary compressor to which the present invention relates may be advantageously used to circulate a refrigerant fluid in an automotive or home air conditioning system and comprises a bored housing and a rotor eccentrically mounted in the bore. The rotor comprises a cylindrical rotor body formed with radial slots in which vanes are slidably retained. In past rotary compressor designs an oil pump is provided to circulate oil from an oil sump to the rotor and rotor bearings for lubrication thereof. In an improved compressor of the present type, no oil pump is necessary and the oil circulation function is performed by means of the pressure difference between the inlet and outlet of the compressor. Specifically, the outlet communicates with the oil sump so that the oil in the sump is pressurized by the high outlet fluid pressure. An oil passageway leads from the oil sump through the interior of the rotor to the inlet so that oil is forced to flow from the oil sump through the rotor and rotor bearings to the low pressure inlet, thereby lubricating the areas of sliding contact between the vanes and the slots and also urging the vanes into sealing engagement with the bore wall. At the inlet, the oil becomes entrained in the refrigerant or working fluid and is sucked into the bore thereby lubricating the areas of sliding contact between the ends of the vanes and the bore wall. The working fluid and oil are subsequently displaced from the bore at elevated pressure to the outlet.

If the oil were allowed to be circulated in the external refrigerant system along with the working fluid which may be FREON (trademark) or the like, it would interfere with heat exchange in the condenser and evaporator and also increase the flow resistance of the fluid mixture, both being adverse effects in an air conditioning system.

It has therefore been a conventional expedient to provide an oil separator component to separate the oil from the refrigerant fluid at the compressor outlet and return the oil to the oil sump. There are two types of oil separators in common use, one type comprising a metal gauze and another type comprising a diverging conduit which causes the flow velocity of the fluid mixture to decrease rapidly enough to separate the oil from the working fluid.

The metal gauze oil separator constitutes a flow restriction which is adverse to the action of the compressor and has a strong tendency to become clogged. In addition, the metal gauze must be replaced periodically.

The diverging conduit type oil separator suffers from the disadvantage that the conduit must be precisely proportioned in order to produce effective oil separation and is therefore a rather expensive component to manufacture. A further disadvantage is that the velocity drop in the oil separator is not compatible with the overall operation of the compressor and external refrigerant circuit.

SUMMARY OF THE INVENTION

It is therefore an object of the present invention to provide an improved rotary compressor in which the disadvantages of known types of oil separators are eliminated.

It is another object of the present invention to provide a rotary compressor in which an oil separation function is provided by a unique configuration of an outlet passageway.

It is another object of the present invention to provide a rotary compressor in which the flow path of working fluid through an outlet passageway reverses direction, thereby effectively producing separation of entrained oil from the fluid.

It is another object of the present invention to provide a rotary compressor which comprises fewer component parts and may therefore be manufactured at lower cost than known compressors of comparable type.

It is another object of the present invention to provide a generally improved rotary compressor.

Other objects, together with the foregoing, are attained in the embodiment described in the following description and illustrated in the accompanying drawings.

BRIEF DESCRIPTION OF THE DRAWING

FIG. 1 is a longitudinal sectional view of a rotary compressor embodying the present invention;

FIG. 2 is a side sectional view taken on a line 2—2 of FIG. 1; and

FIG. 3 is a fragmentary cutaway view of the compressor taken on a line 3—3 of FIG. 2.

DESCRIPTION OF THE PREFERRED EMBODIMENT

While the rotary compressor of the invention is susceptible of numerous physical embodiments, depending upon the environment and requirements of use, substantial numbers of the herein shown and described embodiment have been made, tested and used, and all have performed in an eminently satisfactory manner.

Referring now to the drawings, a rotary compressor 11 embodying the present invention comprises a housing which is generally designated as 12. The housing 12 comprises a cylinder 13 which is formed with a circular bore 14 and end plates 16 and 17 closing the left and right ends (in FIG. 1) of the cylinder 13 respectively. The end plates 16 and 17 are formed with openings (not designated) in which are fitted rolling contact bearings 18 and 19 respectively. Although not shown in detail, the bearings 18 and 19 are of conventional ball or roller construction with spaces between the balls or rollers so that oil can flow longitudinally through the bearings 18 and 19.

A rotor which is generally designated as 21 comprises a shaft 22 which is rotatably supported by the bearings 18 and 19 and a circular rotor body 23 which is fixed to the shaft 22 for unitary rotation. The rotor 21 is eccentrically disposed in the bore 14 so as to be sealingly tangent to the inner wall of the cylinder 13 defining the bore 14 at 24.

The rotor body 23 is formed with a plurality of radial slots 26, here shown as being four in number and equally circumferentially spaced, in which are slidably retained vanes 27 respectively. The rotor body 23, slots 26 and vanes 27 are coextensive with the cylinder 13, the rotor body 23 and vanes 27 sealingly engaging with the end plates 16 and 17.

The assembly comprising the cylinder 13 and end plates 16 and 17 is enclosed by a cylindrical shell 28 and end covers 29 and 31, the end cover 31 being integral with the shell 28. The end cover 31 is formed with a working fluid inlet passageway 32 which leads from an inlet port 33 into the bore 14 through a crescent shaped fluid inlet orifice 34. The shaft 22 extends external of the housing 12 through an opening 36 in the end cover 31 in which is provided a shaft seal 37, the internal wall of the shaft seal 37 partially defining the inlet passageway 32. An outlet orifice 38 leads from the bore 14 through a check valve 39 which prevents reverse flow through the compressor 11, into a first fluid outlet passageway 41. From the outlet orifice 38, the first outlet passageway 41 leads into an annular oil separation chamber 42 which is formed as a cavity in the end cover 29. A second fluid outlet passageway 43 leads from the oil separation chamber 42 to a fluid outlet port 44. The fluid outlet passageways 41 and 43 are formed as preferably parallel cutouts in the periphery of the cylinder 13 and end plate 16 and are separated by a rib 46 of the cylinder 13.

An oil sump 47 is provided at the bottom of the housing 12 and is normally filled with oil up to a level 48. A passageway 49 is formed in the end cover 29 which connects the oil separation chamber 42 with the oil sump 47.

The end plate 16 is formed with a circular high pressure oil chamber 50 which communicates with the oil sump 47 below the oil level 48 through a tube 51. The right face (in FIG. 1) of the end plate 16 is formed with an annular groove 52 which communicates with the high pressure oil chamber 50 through the bearing 18. The left face of the end plate 17 is formed with a similar groove 53 which communicates with the inlet passageway 32 through the bearing 19. The portion of the inlet passageway 32 in which the shaft seal 37 is disposed constitutes a low pressure oil chamber 54. The groove 52 communicates with the groove 53 through the portions of the slots 26 in the rotor body 23 radially inward of the vanes 27.

In a typical air conditioning system incorporating the compressor 11, the fluid inlet port 33 is connected to an evaporator and the fluid outlet port 44 is connected to a condenser of an external refrigerant circuit (not shown). The rotor 21 is adapted to be driven counterclockwise in FIG. 2 by means of the shaft 22. In an automotive air conditioning system, the shaft 22 is connected to the engine through an electromagnetic clutch (not shown).

As viewed in FIG. 2, the vanes 27 sealingly engage with the inner wall of the bore 14 to partition the bore 14 into four working chambers (not designated). In a first semicylindrical portion of the bore 14 measured counterclockwise from 24 to 25, the working chambers increase in volume upon rotation of the rotor 21 thereby creating a vacuum therein which sucks working fluid into the bore 14 from the inlet port 33 through the inlet passageway 32 and inlet orifice 34. In a second semicylindrical portion of the bore 14 measured counterclockwise from 25 to 24, the working chambers decrease in volume thereby compressively displacing the working fluid from the bore 14 through the outlet orifice 38, first outlet passageway 41, oil separation chamber 42 and second outlet passageway 43 to the condenser through the outlet port 44.

It will be noted that the working fluid pressure is below atmospheric in the first cylindrical portion of the bore 14 into which the inlet orifice 34 opens and is above atmospheric in the second semicylindrical portion of the bore 14 from which the outlet orifice 38 opens. Due to the sealing engagement of the ends of the vanes 27 with the wall of the bore 14, the compressor 11 operates on the positive displacement principle.

The rotor 21 and bearings 18 and 19 are lubricated as follows. Since the pressure in the oil separation chamber 42 is high and is applied to the oil sump 47 through the passageway 49, the pressure in the oil sump 47 is high. Conversely, the pressure in the inlet passageway 32 is low. This pressure difference causes oil from the oil sump 47 to flow into the low pressure oil chamber 54, which constitutes part of the inlet passageway 32, through the tube 51, high pressure oil chamber 50, bearing 18, groove 52, slots 26 in the rotor body 23, groove 53 and bearing 19. The pressurized oil in the radially inner portions of the slots 26 serves the dual function of lubricating the sliding contact areas of the vanes 27 and slots 26 and urging the vanes 27 radially outwardly into sealing engagement with the inner wall of the bore 14. The bearings 18 and 19 are lubricated by the oil passing therethrough and the shaft seal 37 is lubricated and cooled by the oil in the low pressure oil chamber 54.

The oil is sucked from the low pressure oil chamber 54 through the inlet passageway 32 and inlet orifice 34 into the bore 14 where it serves to lubricate the sliding contact areas of the outer ends of the vanes 27 and the inner wall of the bore 14. The entrained oil is discharged discharged along with the working fluid through the outlet orifice 38 and enters the oil separation chamber 42. The oil is removed from the working fluid in the oil separation chamber 42 and is returned to the oil sump 47 through the passageway 49. The working fluid, with the oil removed, is pumped out of the compressor 11 through the outlet port 44 to the condenser.

The configuration of the oil separation chamber 42 in combination with the outlet passageways 41 and 43 is uniquely designed to accomplish separation of the entrained oil from the working fluid without the need of a discrete oil separator component. In FIG. 3, arrows designate the flow path of the working fluid from the outlet orifice 38 and check valve 39 through the first outlet passageway 41 into the oil separation chamber 42, through the oil separation chamber 42 and from the oil separation chamber 42 through the second outlet passageway 43 to the outlet port 44. It will be seen that the passageways 41 and 43 open perpendicularly into the oil separation chamber 42 and that the working fluid flows leftwardly in the first outlet passageway 41, downwardly in the oil separation chamber 42 and rightwardly in the second outlet passageway 43 as viewed in FIG. 3. In other words, the working fluid flow path reverses direction in the oil separation chamber 42, entering the oil separation chamber 42 leftwardly and emerging from the oil separation chamber 42 rightwardly. It is this extreme change in direction of the working fluid flow path which effects separation of the entrained oil from the working fluid.

Specifically, the entrained oil is in the form of liquid droplets which are much greater in density than the working fluid, which is in gaseous form. Whereas the pressure gradient in the oil separation chamber 42 is sufficient to cause the light molecules of working fluid to negotiate the change of direction therein at the velocity associated with the normal operating flow rate through the compressor 11, the inertial force of the oil droplets, due to their higher density, is stronger than the pressure gradient. The oil droplets thereby continue moving substantially straight after emerging from the first outlet passageway 41 and impinge against the inner wall of the left cover 29 defining the oil separation chamber 42. The viscous force between the oil and the wall of the end cover 29 prevents the oil from again being mixed with the working fluid in the oil separation chamber 42, and the oil is caused to flow by the combination of gravity and the pressure in the oil separation chamber 42 downwardly into the oil sump 47 through the passageway 49.

In summary, it will be seen that the radical change in the direction of the flow path of the working fluid in the oil separation chamber 42 accomplishes effective separation of the entrained oil from the working fluid since the oil droplets are unable to negotiate the change in direction. The objects of the invention including the elimination of a discrete oil separator component and the detrimental operating effects associated with such a component are thereby attained.

Although the present invention has been shown and described as being embodied by a compressor comprising a housing with a circular bore and a rotor having a circular body, the invention is also applicable to a compressor comprising a noncircular bore and/or rotor and also to a compressor comprising a rotary gear or screw as the fluid displacing element. Many other modifications within the scope of the invention will become possible for those skilled in the art after receiving the teachings of the present disclosure.

What is claimed is:

1. A rotary compressor comprising, in combination:

a housing having a cylinder formed with a bore and first and second end plates closing ends of the cylinder;

a fluid inlet passageway leading from a fluid inlet port into the bore;

an oil separation chamber being formed as an annular cavity in one of the end plates;

a first fluid outlet passageway leading from the bore into the oil separation chamber;

a second fluid outlet passageway leading from the oil separation chamber to a fluid outlet port, the first and second fluid outlet passageways being separated by a rib of the cylinder;

a rotor operatively disposed in the bore in such a manner as to compressively displace working fluid from the fluid inlet passageway to the first fluid outlet passageway;

an oil sump in communication with the oil separation chamber; and an oil passageway leading from the oil reservoir to the fluid inlet passageway and communicating with the rotor in such a manner that oil is caused to flow through the oil passageway for lubrication of the rotor when a working fluid pressure in the oil separation chamber is greater than a working fluid pressure in the fluid inlet passageway;

the first and second fluid outlet passageways being formed as substantially parallel longitudinal passageways in the cylinder and opening perpendicularly into the oil separation chamber so that a working fluid flow path defined therethrough changes direction in the oil separation chamber to an extent great enough that oil entrained in working fluid flowing through the oil separation chamber is unable, due to an inertial force of the oil, to negotiate said change in direction, is separated from the working fluid and flows from the oil separation chamber into the oil reservoir.

2. A rotary compressor as in claim 1, in which the rotor comprises a rotor body formed with substantially radial slots and a plurality of vanes slidably retained in the slots respectively, the oil passageway being partially defined by radially inner portions of the slots so that oil therein urges the vanes radially into sealing engagement with an inner wall of the bore.

3. A rotary compressor as in claim 2, in which the bore and the rotor body are circular in section, the rotor being eccentrically disposed in the bore so that the rotor body is tangent to the inner wall of the bore.

4. A rotary compressor as in claim 2, in which the slots and vanes are coextensive with the rotor body.

5. A rotary compressor as in claim 2, in which the first and second end plates of the housing are formed with openings therethrough respectively, the openings communicating with said radially inner portions of the slots of the rotor body and partially defining the oil passageway, one of the openings communicating with the oil reservoir and the other of the openings communicating with the fluid inlet passageway.

6. A rotary compressor as in claim 5, in which the rotor further comprises a shaft fixed to the rotor body, the compressor further comprising a bearing formed with a longitudinal passageway therethrough mounted in the opening of one of the end plates to rotatably support the shaft, the longitudinal passageway of the bearing partially defining the oil passageway.

* * * * *